US005626818A

United States Patent [19]

Wack et al.

[11] Patent Number: 5,626,818

[45] Date of Patent: May 6, 1997

[54] PROCESS FOR INHIBITING CORROSION

[75] Inventors: Oskar K. Wack, Stammham-Westerhofen; Martin Hanek, Hilpoltstein, both of Germany

[73] Assignee: Dr. O.K. Wack Chemie GmbH, Germany

[21] Appl. No.: 657,432

[22] Filed: Jun. 3, 1996

Related U.S. Application Data

[63] Continuation of Ser. No. 277,186, Jul. 19, 1994, abandoned.

[30] Foreign Application Priority Data

Jul. 27, 1993 [DE] Germany ..... 43 25 133.1

[51] Int. Cl.[6] ..... C23F 11/00; C23F 11/12

[52] U.S. Cl. ..... 422/14; 134/42

[58] Field of Search ..... 134/26–29, 40, 134/42, 22.19, 22.14, 2; 252/162, 164; 422/13, 14

[56] References Cited

U.S. PATENT DOCUMENTS

| | | | |
|---|---|---|---|
| 3,882,038 | 5/1975 | Clayton et al. | 252/164 |
| 3,939,090 | 2/1976 | Zmoda | 252/90 |
| 4,476,261 | 10/1984 | Patzaschke et al. | 523/402 |
| 4,485,131 | 11/1984 | Adams et al. | 427/388.2 |
| 4,808,235 | 2/1989 | Woodson et al. | 134/22.19 |
| 5,102,573 | 4/1992 | Han et al. | 252/153 |
| 5,186,744 | 2/1993 | Bodwell et al. | 106/243 |
| 5,221,330 | 6/1993 | Matsumoto et al. | 106/2 |
| 5,268,035 | 12/1993 | Neubauer et al. | 134/2 |

*Primary Examiner*—Jill Warden
*Assistant Examiner*—Alexander Maruff
*Attorney, Agent, or Firm*—Lalos & Keegan

[57] ABSTRACT

A mixture of propyleneglycolmethylether and propyleneglycolether which is added in a ratio of 60:40 and 90:10 to the last rinsing bath in which metal parts are cleaned, in order to achieve intermediate corrosion resistance.

3 Claims, No Drawings

PROCESS FOR INHIBITING CORROSION

This is a continuation application Ser. No. 08/277,186 filed on Jul. 19, 1994 now abandoned.

This invention relates to a rinsing process for cleaning articles without causing corrosion or the like.

A generic process is known from non-prepublished German patent application P 43 09 096.

Articles to be cleaned, such as metal and particularly steel, are subjected to a typical cleaning process in a cleaning bath by immersion that may include ultrasonic reinforcement. The cleaning bath is then removed from the articles in an aqueous rinsing bath. Because of the impurities including the cleaning bath entrained into the first rinsing bath, a second rinsing bath followed by a drying process is advisable to insure complete rinsing.

The danger of trace corrosion exists, especially in the case of steel articles but also in that of articles of other metals such as aluminum, because of residual moisture on the material during the drying process. Such corrosion presents a problem in particular if the articles dried are to be further processed, for example, if the articles are to be coated.

The object of this invention is to reduce the risk of corrosion.

The present invention is directed to the addition of a 10–50% by weight, preferably 25%, mixture of glycolethers such as, propyleneglycolethers into the last rinsing bath. It has been found, to the inventors' surprise, that addition of such a glycolether mixture of the composition indicated significantly improves the pattern of drainage of water from articles removed from the water, in that the water drains off as a curtain. A film-like coating is apparently formed at the same time and provides effective protection from oxidation, and accordingly corrosion, for a limited period of around 24 hours.

In order to prevent spotting, the last rinsing bath consists of fully desalinated water (VE water). The glycolether mixture referred to of different propyleneglycolethers, A and B is added in a concentration of around 10–50%.

Propyleneglycolether A present in the range of 60–90% by weight of the glycolether mixture has the formula:

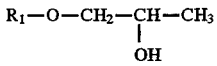

where $R_1$ is $CH_3$, $C_2H_5$, n—$C_3H_7$, iso—$C_3H_7$.

Propyleneglycolether B, constituting 40-10% by weight of the mixture has the formula:

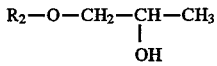

where $R_2$ is n—$C_3H_7$, iso—$C_3H_7$, n—$C_4H_9$, iso—$C_4H_9$. is an example of the propyleneglycolether.

EXAMPLE 1

Unacceptable Procedure

Metal parts of steel that are to be cleaned are treated in a cleaning bath of glycolethers and the residues of the cleaning bath are then removed in a first aqueous bath. In order to achieve complete removal of the cleaning bath residues, including those entrained into the first rinsing bath, the parts are rinsed in a second bath of completely desalinated water and then dried in a stream of hot air. The drying period is around three minutes; its duration is heavily dependent on the temperature of the hot air stream and the velocity of the air.

A trace of rust is detected with the unaided eye immediately after completion of the drying.

In the following example of the present invention, no rust results from the rinsing.

EXAMPLE 2

The same metal parts as indicated in Example 1 are treated in the same cleaning bath and the residues are also removed from the parts in a first rinsing bath. There is, however, added to the second rinsing bath a 10–50% by weight mixture of propyleneglycolmonomethylether of the formula

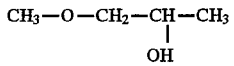

and of propyleneglycol-n-butylether of the formula

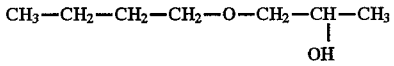

in a ratio of 80% by weight propyleneglycolmonomethylether and 20% by weight propyleneglycol-n-butylether.

Drainage of the rinsing bath in the form of a curtain from the articles removed after rinsing reduced the drying time by one-half. No trace of corrosion was detected, even after thorough inspection, 24 hours later, and accordingly the dried parts could be additionally processed, as for example by coating, within this period without further protective measures having been taken.

We claim:

1. A process for inhibiting corrosion of metal articles comprising, rinsing the articles in an aqueous rinsing bath, said rinsing bath including 10–50% by weight glycolethers of the following composition:

60–90% by weight propyleneglycolether of the formula

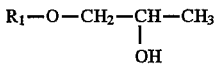

$R_1$ being selected from the group $CH_3$, $C_2H_5$, n—$C_3H_7$, or iso—$C_3H_7$, and 40-10% by weight propyleneglycolether of the formula

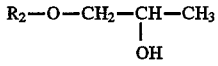

$R_2$ being selected from the group n—$C_3H_7$, iso—$C_3H_7$, n—$C_4H_9$, or iso—$C_4H_9$.

2. A process as claimed in claim 1, wherein propylene glycol ether of the formula
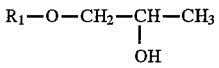
is propylene glycol monomethyl ether.
3. A process as claimed in claim 1 or 2, wherein propylene glycol ether of the formula
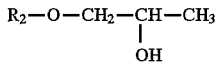
is propylene glycol n-butyl ether.
* * * * *